United States Patent [19]

Heimberger

[11] 4,075,874

[45] Feb. 28, 1977

[54] SLIDE-FASTENER STRINGER HALF WITH KNITTED-IN COUPLING ELEMENTS AND METHOD OF MAKING SAME

[75] Inventor: Helmut Heimberger, Locarno, Switzerland

[73] Assignee: Optilon W. Erich Heilmann GmbH, Cham, Switzerland

[21] Appl. No.: 728,034

[22] Filed: Sep. 30, 1976

[30] Foreign Application Priority Data

May 20, 1976 Germany ..... 2622529

[51] Int. Cl.[2] ..... D04B 23/08; D04B 23/10

[52] U.S. Cl. ..... 66/192; 66/195; 66/190; 24/205.16 C

[58] Field of Search ..... 60/190–195; 24/205.1 R, 205.1 C, 205.13, 205.16 C

[56] References Cited

U.S. PATENT DOCUMENTS

| | | | |
|---|---|---|---|
| 3,442,099 | 5/1969 | Auville et al. | 66/195 |
| 3,651,666 | 3/1972 | Austin | 66/207 |
| 3,864,945 | 2/1975 | Frolich | 60/193 |
| 3,881,326 | 5/1975 | Bourgeois | 66/195 |

FOREIGN PATENT DOCUMENTS

| | | | |
|---|---|---|---|
| 2,216,832 | 10/1973 | Germany | 24/205.16 C |
| 2,103,774 | 8/1972 | Germany | 66/193 |

*Primary Examiner*—Ronald Feldbaum
*Attorney, Agent, or Firm*—Karl F. Ross

[57] ABSTRACT

A slide-fastener stringer half comprises a knit tape having a plurality of parallel longitudinally extending wales and a plurality of transversely extending courses, and a monofilamentary coupling element on the tape and having a succession of turns each having a pair of shanks and a coupling head joining the shanks and projecting transversely beyond the longitudinal edge of the tape. The shanks of each turn lie at least in regions adjacent the respective head in a plane generally perpendicular to the tape. The tape comprises at least one warp yarn forming a chain knitted into the tape at every other course and overlying the shanks at the regions adjacent the heads. Thus the shanks are laid into the chains at these regions so that the coupling element is thoroughly integrated into the knit of the tape. The tape itself may be formed of a full-tricot ground. Alternatively the tape can be formed of second weft yarns having open loops at each course and extending transversely each over two respective wales.

2 Claims, 4 Drawing Figures

SLIDE-FASTENER STRINGER HALF WITH KNITTED-IN COUPLING ELEMENTS AND METHOD OF MAKING SAME

CROSS-REFERENCE TO RELATED APPLICATIONS

This application is related to my copending and commonly assigned patent applications Ser. No. 728,031, Ser. No. 728,134, Ser. No. 728,033, Ser. No. 728,135, Ser. No. 728,133, Ser. No. 728,035, Ser. No. 728,031 and Ser. No. 728,132, all filed Sept. 30, 1976.

FIELD OF THE INVENTION

The present invention relates to a slide-fastener stringer half and method of making same. More particularly this invention concerns such a stringer half wherein a monofilamentary coupling element is knitted directly into the support tape.

BACKGROUND OF THE INVENTION

A slide-fastener stringer half is known having a coupling element formed as a synthetic-resin monofilament with a longitudinal succession of turns each having a pair of shanks connected together by a coupling head, with one of the shanks of each turn connected via a bight to a shank of an adjoining turn. It is known to lay these shanks directly into a knit support tape so that the coupling element itself forms part of the knit and stitching is not necessary to secure the stringer half together. In such an arrangement the coupling head extends laterally beyond one of the longitudinal edges of the support tape (see Japanese patent JA-PS No. 38-11 673).

In some arrangements the two shanks of each turn are knitted into adjacent but succeeding and separate courses of the knitted support tape. The coupling heads joining the two shanks of each turn project laterally from a longitudinal edge of the tape and lie in a plane which extends generally perpendicular to the tape. This perpendicular position is necessary in order to prevent the slide-fastener formed with such a stringer from opening accidently (see German open application DT-OS No. 22 21 325).

It has also been suggested to knit both of the shanks into a single course. This makes the manufacture of the coupling tape extremely difficult with conventional warp-knitting machines. Complicated control mechanisms are invariably required. The main difficulty is that when a coupling element made from a synthetic-resin monofilament of normally around 0.5 mm diameter is knitted into the tape it is not possible readily to conform the course locations to the gauge (head spacing) of the coupling element so that such a coupling-element coil can be knitted into each course.

OBJECTS OF THE INVENTION

It is therefore an object of the present invention to provide an improved slide-fastener stringer half and method of making same.

Another object is the provision of such a stringer half into which the coupling element is integrally knitted, yet which overcomes the above-given disadvantages.

Yet another object is to provide such a coupling element whose coupling heads lie in a plane generally perpendicular to the tape, but which is advantageously laid into the knitted tape and which can be produced by means of conventional knitting machinery.

Another object is to provide a knitted-tape stringer which can withstand all of the stresses which arise in use and which nevertheless has its coupling members or eyes lying substantially in planes perpendicular to the plane of the tape.

SUMMARY OF THE INVENTION

These objects are attained according to the present invention in a slide-fastener stringer half of the above-described general type wherein the two shanks of each turn lie at least adjacent their coupling heads in a respective plane generally perpendicular to the support tape, that is lie one over the other relative to the support tape, and wherein the tape is formed in part of at least one chain-forming or pillar forming warp yarn which is knitted into the tape only in every other course and overlies the two shanks of a respective turn in between each knitted-in location.

Thus it is possible to use a support tape of very compact structure, that is of very fine gauge, since the spacing between adjoining turns of the coupling element is twice the distance between adjoining courses. Such a slide-fastener stringer half can readily be made on conventional warp-knitting machinery.

It is also within the scope of this invention to form the ground knit as a warp knit with a plurality of warp yarns each forming a pillar or chain having an open loop at each course and extending each over two wales. Such a tape can readily be made on conventional knitting machinery with no modification whatsoever.

Furthermore a tape of extremely good longitudinal and transverse dimensional stability is obtained while the stringer half so manufactured is exceptionally durable. What is more, the alignment of each of the coupling heads in a plane generally perpendicular to the plane of the tape makes a slide-fastener stringer which is extremely unlikely to open inadvertently or accidentally in use, as the coupling heads of adjoining halves can join so securely together that they can only be separated by means of the slider.

In accordance with yet another feature of this invention, after knitting-together of the tape as described above, the warp yarns at least are shrunk. This tends to pull the tape tightly into contact with the underside of the slide fastener and make the entire stringer half an absolutely unified and virtually integral assembly.

It is possible in accordance with this invention to extend the tape transversely away from the coupling element. In such an arrangement the warp chains that secure the coupling element in place need not be provided in that portion of the tape free of the coupling element. It is another feature of this invention, however, to form a so-called strip slide-fastener stringer, wherein the coupling element extends the full transverse width of the support tape so that the heads project along one edge and the bights along the other. Thus the warp yarns that secure the coupling element into the tape, like needle threads of conventional double chain or lock stitching, extend across the full width of the tape. In this last-mentioned arrangement the integration of the coupling element into the tape is extremely good so that a dimensionally stable slide-fastener stringer half is obtained from which it is virtually impossible to withdraw the coupling element.

Strip-type slide fasteners are described, for example, in German published application DT-AS No. 11 71 659 (FIG. 1).

A slide-fastener spring half is made in accordance with this invention on a knitting machine having first and second guide bars which are used to form a ground knit, e.g. a full tricot, and an end guide bar which serves to form the warp chain in every second course, blind-lapping in the intervening courses, so as to hold in the coupling element. This coupling element itself, which is already in generally helicoidal shape, is simply fed in through a groove in the machine so that it automatically is integrated into the tape. It is possible to tension the warp yarns very tightly so that they pull the tape into very close juxtaposition with the coupling element, indeed forcing it into the spaces between adjoining turns. This insures that the assembly will be almost an integral piece.

According to yet another feature of this invention two such slide-fastener stringer halves are made at the same time. During such manufacture the coupling heads of the two coupling elements are automatically interleaved, and the warp yarns are oppositely lapped in each of the coupling tapes. It is necessary in such an arrangement to provide separate guide bars for each of the warp yarns.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
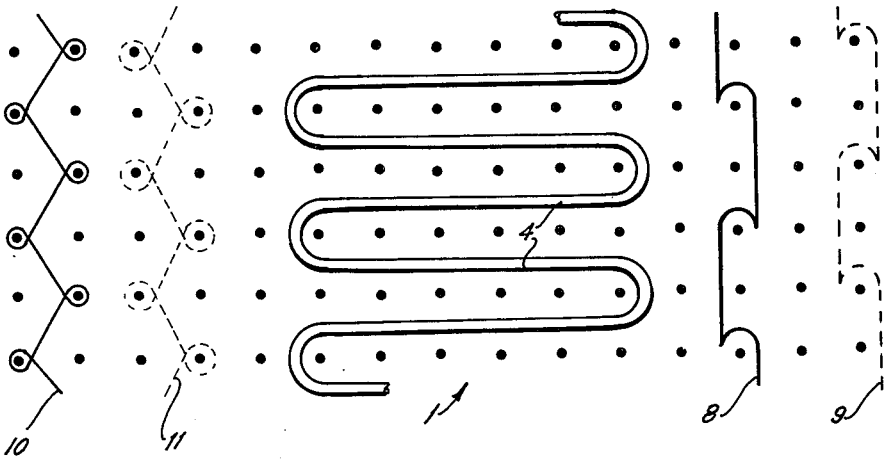
FIG. 1 is a large-scale diagrammatic view showing a stringer with two halves.

As shown in FIG. 1 a slide-fastener stringer half has a helicoidal coupling element 1 and a knit tape 3 having a longitudinal succession of transversely extending courses 2 and a plurality, here four, of parallel longitudinally extending wales 14. The coupling element 1 is a synthetic-resin monofilament formed with a longitudinal succession of turns 7 each in turn having a pair of parallel shanks 4 lying in a plane perpendicular to the longitudinal axis of the arrangement and perpendicular to the tape.

The warp chains are of the single-bar or single-needle type described in the aforementioned U.S. patent, i.e. each wale is a single warp chain so that valleys are defined between the wales. The warp chains are not interconnected, the sole connection between them being the laid-in weft.

These shanks 4 extend beyond a longitudinal edge 6 of the tape and are interconnectable at their ends beyond this edge 6 by means of coupling heads which each are flattened and lie in the plane of the respective shanks. At their rear ends the shanks 4 extend beyond the opposite edge of the tape 3 and each upper shanks 4 is connected via a bight to the lower shank of an adjoining turn. Thus the arrangement is a so-called strip fastener.

Figure 2:
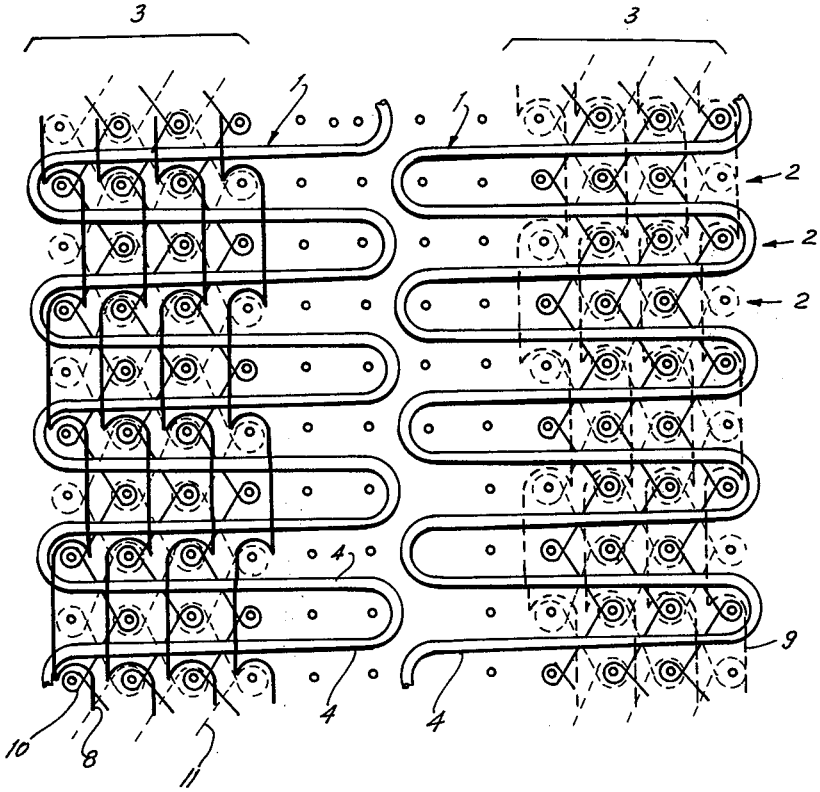
FIG. 2 is a point-paper diagram illustrating the knit of the tapes of the stringer halves of FIG. 1.

As is also shown in FIGS. 1 and 2 the tape 3 is made up of a full-tricot ground (double tricot) knit constituted by lapped yarns 10 and 11. The coupling element lies on top of the ground knit formed by these yarns 10 and 11 and is secured thereto by means of warp filaments 8 or 9 each of which form an open loop pillar or chain only knitted into the tape at every other course 2.

It is noted that the views of FIGS. 1 and 2 of the pattern show the shanks 4 next to each other, whereas in reality they lie directly over each other. Thus as best shown in FIG. 1 two tapes 3 are formed simultaneously, one using four warp yarns 8 and one using four warp yarns 9, but both having the full-tricot ground formed of the filaments 10 and 11. When the tapes are knitted the coupling elements 1 are laid into them as a weft with their coupling heads interleaved. Similarly it is noted that the two shanks 4 of each turn are aligned over every other course 2, leaving exposed the course 2 into which the securing warp yarn chains 9 are knitted.

Thus the tape shown in FIG. 1 is knitted with the following pattern:

coupling element 1—6-6/0-0,
element-securing warp yarn 8—2-2/2-0/0-0/0-2,
element-securing warp yarn 9—0-2/0-0/2-0/2-2,
tricot yarn 10—1-0/1-2, and
tricot yarn 11—1-2/1-0.

It is noted that the chain 8 is only knitted in every other course, and that the yarns 10 and 11 are lapped against each other. The element 1 is also preformed into the desired helicoidal shape so that it automatically falls in the desired position.

Figure 3A:
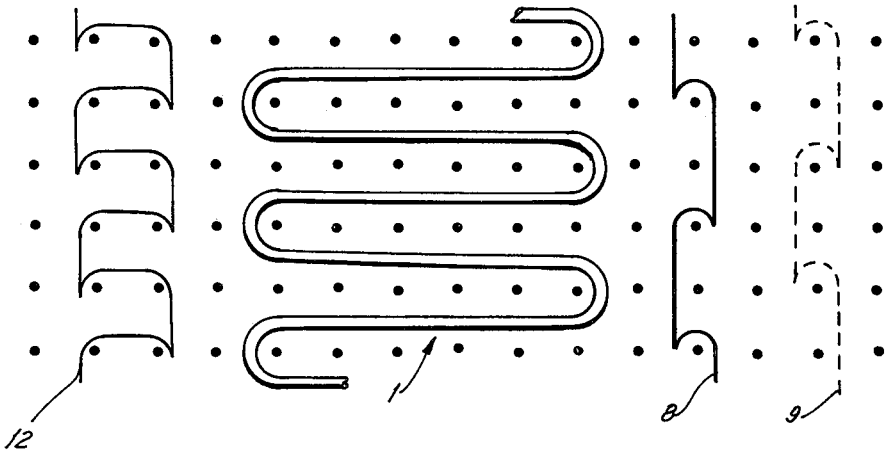
FIGS. 3 and 3A are views similar to FIGS. 1 and 2 showing another arrangement in accordance with the present invention.
Figure 3:
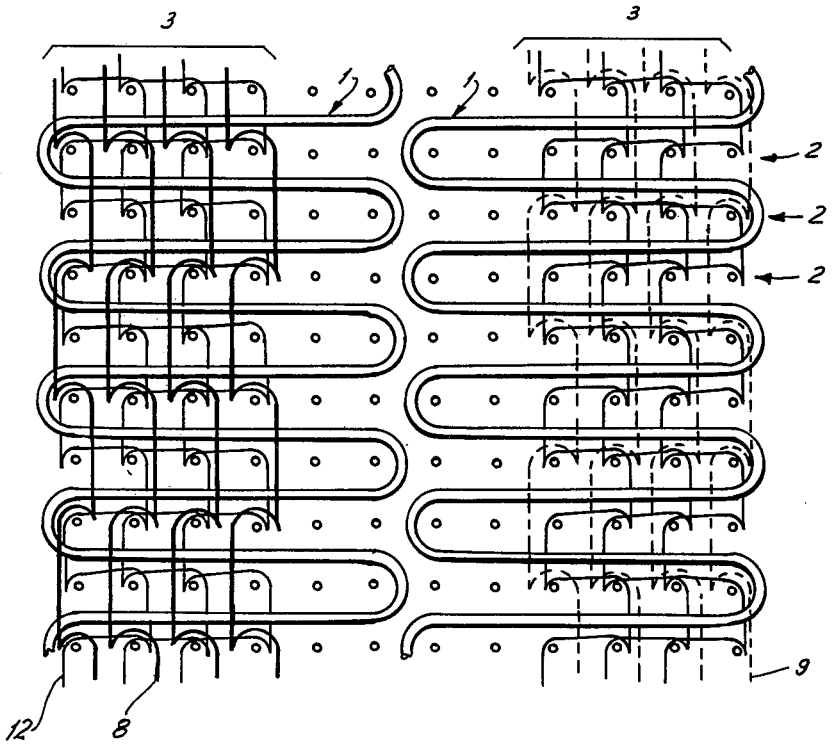

The knit shown in FIGS. 3 and 3A is identical to that shown in FIGS. 1 and 2, except that the ground knit is formed of warp filaments 12 forming open-loop warp chains each extending over two wales 14, with loops at each course 2. Thus the warp yarn 12 is patterned 2-0-/0-2.

The slide-fastener stringer half according to this invention has extremely good dimensional stability. It can be produced on a conventional warp-knitting machine, and the coupling element is so thoroughly integrated into the tape that separation of the two is virtually impossible. Furthermore since the coupling heads are aligned in the most desirable position a slide fastener can be produced from such a stringer half which is extremely strong and unlikely to pull apart in use.

I claim:

1. A slide-fastener stringer half comprising a full tricot ground knit tape and a monofilament coupling element on said tape having a series of turns each having a pair of shanks and projecting transversely beyond a longitudinal edge of said tape, and securing warp filaments warp-knitted into said tape and overlying said shanks, said turns each comprising a pair of such shanks lying along alternate courses of said tape and said warp filament constituting warp pillars chain-knitted into said tape at the remaining courses.

2. A slide-fastener stringer half comprising a warp filament ground knit tape and a monofilament coupling element on said tape having a series of turns each having a pair of shanks and projecting transversely beyond a longitudinal edge of said tape, and securing warp filaments warp-knitted into said tape and overlying said shanks, said turns each comprising a pair of such shanks lying along alternate courses of said tape and said warp filament constituting warp pillars chain-knitted into said tape at the remaining courses.

* * * * *

UNITED STATES PATENT AND TRADEMARK OFFICE

CERTIFICATE OF CORRECTION

PATENT NO. : 4,075,874

DATED : 28 February 1978

INVENTOR(S) : Helmut Heimberger

It is certified that error appears in the above–identified patent and that said Letters Patent are hereby corrected as shown below:

For the issue date and wherever otherwise applicable, read:

[45] Feb. 28, 1978

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*